United States Patent [19]

Johnson et al.

[11] Patent Number: 4,824,586

[45] Date of Patent: Apr. 25, 1989

[54] METAL WORKING LUBRICANT

[75] Inventors: Mark D. Johnson; Nelson W. Smith, both of Cortland, N.Y.

[73] Assignee: Pennwalt Corporation, Philadelphia, Pa.

[21] Appl. No.: 92,024

[22] Filed: Sep. 1, 1987

[51] Int. Cl.[4] ..... C10M 173/00

[52] U.S. Cl. ..... 252/49.5; 252/51.5 R; 252/52 A

[58] Field of Search ..... 252/49.5, 52 A

[56] References Cited

U.S. PATENT DOCUMENTS

| | | | |
|---|---|---|---|
| 3,748,275 | 7/1973 | Bernheim et al. | 252/49.5 |
| 3,793,351 | 2/1974 | McCoy | 252/52 A |
| 4,100,078 | 7/1978 | Kleber et al. | 252/52 A |
| 4,185,485 | 1/1980 | Schick et al. | 252/49.5 |
| 4,539,125 | 9/1985 | Sato | 252/49.5 |
| 4,661,275 | 4/1987 | Forsberg et al. | 252/49.3 |

*Primary Examiner*—William R. Dixon, Jr.
*Assistant Examiner*—Ellen McAvoy

[57] ABSTRACT

An improved acidic metal working lubricant composition that is adapted to deposit oil upon the metal surfaces being treated at an acidic pH, which composition includes an alkaline activated surface active agent to promote cleansing of the deposited oil from the metal surfaces during alkaline cleaning of the metal surfaces after metal working without affecting lubricant performance during metal working.

8 Claims, No Drawings

METAL WORKING LUBRICANT

BACKGROUND OF THE INVENTION

In the cold rolling of steel slabs to produce sheets or other shapes, a composition is typically used as a lubricant and cooling medium. These compositions are typically relatively unstable emulsions (intentionally) at the acidic pH of use to cause the oil of the emulsion to deposit onto the surfaces of the metals being rolled. However, it may be difficult to remove these oils from the metal surfaces if necessary prior to the next operation.

High speed tandem mill rolling oils are typically designed to form controlled, unstable emulsions with specific particle size distributions and lubricant deposition rates. Most of these products incorporate combinations of ethoxylated cationic emulsifiers in relatively small quantities, normally less than one percent total concentration, which by nature promote higher deposition rates for a given particle size distribution. Nonionics are also used to some extent, but as with the cationics their total concentration is limited by emulsion stability requirements for lubrication. Additionally, these rolling oils are generally buffered to a pH of less than 7 to minimize the undesirable soap formation.

Regardless of the type of emulsifier, the low total concentration in these rolling oil formulations does not significantly contribute to the ease of rolling oil removal in subsequent cleaning operations. In fact, once neutralized in an alkaline cleaning bath, cationic emulsifers can be almost totally inactivated.

The present invention provides a rolling oil composition that includes an alkaline active surfactant without changing the emulsification characteristics, such as particle size distribution or deposition rate, yet the composition provides drastically improved cleaning efficiency and rinsing properties of the deposited rolling oils in subsequent alkaline cleaning cycles.

SUMMARY OF THE INVENTION

The invention is defined as in an acidic metal working lubricant composition for treatment of metal surfaces, which composition has a pH of less than 7.0 and includes an unstable, oil-based water emulsion containing an emulsifying effective amount of an acidic active surface active agent to provide deposition of the oil onto the metal surfaces being treated; the improvement which comprises incorporating in the composition an oil emulsifying and cleansing effective amount of an alkaline activated surface active agent to promote cleansing of the deposited oil from the metal surfaces during alkaline cleaning of the metal surfaces after metal working.

The oils are selected from the group consisting essentially of mineral oil, natural triglycerides, vegetable oils, wax, and synthetic oils. Preferably, they comprise from 80% to 99% by weight of the nonaqueous ingredients of the composition.

Typically, the alkaline surface active agent can be a polyoxyalkylamine that has 5 to 20 ethoxy units per mole and comprises from 0.1% to 10.0% by weight of the nonaqueous ingredients of the composition.

The aqueous portion of the composition comprises from 80% to 99% by weight of the composition. Customarily, most of the aqueous portion of the composition is added to the nonaqueous concentrate just prior to use.

The method of the invention comprises the use of the above lubricant compositions in an otherwise typical metal working method.

DETAILED DESCRIPTION OF THE INVENTION

The following examples illustrate this inventioon, but it is understood that in no way does the specific compositions used set limits on this invention. This invention is applicable for any emulsifiable metal working fluid designed for acidic pH operation (pH less than 7) where improved cleanability is desired, but was previously limited by emulsion stability lubrication requirements.

EXAMPLE I

The following formula A is representative of a typical emulsifiable rolling oil as used on high speed tandem mills. Formulation B incorporates the alkaline active surfactant.

| Ingredients (wt. %) | Formula A | Formula B |
|---|---|---|
| Tallow | 92.6 | 90.6 |
| Tallow Fatty Acids | 5.0 | 5.0 |
| Acidic Buffer | 2.0 | 2.0 |
| Ethoxylated Cationic Surfactant | 0.4 | 0.4 |
| Alkaline Active Surfactant (polyethoxyalkylamine having 15 ethoxy units per mole) | — | 2.0 |

Using a laboratory recirculation system, 5% emulsions were conditioned for 30 minutes at 130° F. in distilled water. A Coulter Counter was used to determine the particle size distribution of the emulsion, and the relative deposition rate for each was determined. The results, which show that the addition of the alkaline active surfactant does not significantly change the emulsion characteristics of the rolling oil, are as follows:

| Particle Size Distribution | | | | |
|---|---|---|---|---|
| Coulter Counter Model $T_A$ (100μ tube) | | Normalized % Differential Volume | | |
| Channel | (Diameter μ) | Formula A | Formula B | Formula C |
| 2 | 1.26 | 0.9 | 2.6 | 1.0 |
| 3 | 1.59 | 1.4 | 3.8 | 1.8 |
| 4 | 2.00 | 2.3 | 5.3 | 3.1 |
| 5 | 2.52 | 2.5 | 4.2 | 3.5 |
| 6 | 3.17 | 5.0 | 6.7 | 7.1 |
| 7 | 4.00 | 7.3 | 7.9 | 9.8 |
| 8 | 5.04 | 11.0 | 10.7 | 13.7 |
| 9 | 6.35 | 13.0 | 11.1 | 14.1 |
| 10 | 8.00 | 15.8 | 12.8 | 14.3 |
| 11 | 10.08 | 15.3 | 12.2 | 12.8 |
| 12 | 12.7 | 10.6 | 9.6 | 9.7 |
| 13 | 16.0 | 6.2 | 6.8 | 5.2 |
| 14 | 20.2 | 2.9 | 2.9 | 3.0 |
| 15 | 25.4 | 2.1 | 1.8 | 0.6 |
| 16 | 32.0 | 4.5 | 2.0 | 0.4 |
| Deposition Rate (Relative mg./unit area of metal) | | 10.8 | 13.5 | 7.7 |
| Emulsion pH | | 4.4 | 4.4 | 4.7 |

In the above table, formulas B and C are identical, with the exception that formula B was adjusted with phosphoric acid to lower pH to equal that of formula A. This was done to compensate for the alkaline buffering action of the alkaline active surfactant. The deposition rate and particle size distribution fluctuate somewhat with the pH, which is typical for these products. Overall, the addition of the alkaline active surfactant had no significant effect on the emulsion characteristics. In a typical formulation, the acidic buffer could be increased slightly to completely negate the alkaline active surfactant's pH effects.

In contrast, the inclusion of the alkaline active surfactant drastically increased the cleaning efficiency of the rolling oil removal. Steel panels were coated with both formula A and B in equal film weights and subsequently immersed in a 4 oz./gal. sodium orthosilicate cleaning bath for two seconds at 140° and 180° F. The panels were then rinsed in distilled water, dryed and tested on a Coulometric Carbon Analyzer to determine residual carbon levels (indicative of the quantitative presence of oil). Six runs were completed for each variable, and the average for each is reported below:

| | Residual Carbon (μ grams/square inch) 180° F. | 140° F. |
|---|---|---|
| Formula A | 97.9 | 451.0 |
| Formula B | 51.0 | 304.0 |

This increase in cleaning efficiency translates into a tremendous impact on steel mill cleaning operations. Use of the composition of the invention provides cleaning at higher speeds, lower cleaner concentrations and/or lower temperatures in the subsequent alkaline cleaning operations.

EXAMPLE II

Because many rolling oils are based on mineral oil or a combination of mineral oil and tallow rather than tallow or white grease (which are composed mainly of triglyceride fats), a similar experiment to Example I using mineral oil rather than tallow as the base lubricant was conducted. The data generated follows:

| Ingredients (wt. %) | Formula D | Formula E |
|---|---|---|
| 300 SUS Naphthenic Mineral Oil | 92.6 | 89.6 |
| Tallow Fatty Acids | 5.0 | 5.0 |
| Acidic Buffer (2-ethyl hexanoic Acid) | 2.0 | 3.0 |
| Ethoxylated Cationic Surfactant | 0.4 | 2.0 |
| Alkaline Active Surfactant (polyethoxyalkylamine having 15 ethoxy units per mole) | — | 2.0 |

As in the previous example 5% emulsions were prepared and conditioned for 30 minutes at 130° F. in distilled water using a laboratory recirculation system. A Coulter Counter as in Example I was used to determine the particle size distribution of the emulsions, and the deposition rate for each was determined using a standard method. This method involves passing a preweighed, clean, dry steel panel of known dimensions through the prepared emulsions as it is being sprayed through opposing spray nozzles in a cabinet. The panels are then dipped in cold tap water to remove any emulsified oil on their surface, then dried and reweighed. The amount of oil remaining on the panel in milligrams is then recorded as the deposition rate.

Rather than buffering the emulsion with phosphoric acid as in the previous example to compensate for the alkaline buffering action of the alkaline active surfactant, the concentration of 2-ethlhexanoic acid was increased. As in the earlier example, the results show that the relatively large addition of the alkaline active surfactant does not significantly change the emulsion characteristics of the rolling oil.

| Coulter Counter Channel | Particle Size Distribution Normalized % Differential Volume Formula D | Formula E |
|---|---|---|
| 2 | 0.3 | 0.6 |
| 3 | 0.6 | 1.1 |
| 4 | 1.2 | 1.9 |
| 5 | 1.9 | 2.6 |
| 6 | 5.0 | 6.8 |
| 7 | 8.6 | 11.3 |
| 8 | 13.9 | 17.8 |
| 9 | 16.7 | 18.7 |
| 10 | 18.6 | 16.4 |
| 11 | 13.7 | 10.0 |
| 12 | 8.0 | 5.8 |
| 13 | 4.4 | 3.1 |
| 14 | 2.7 | 1.3 |
| 15 | 1.4 | 0.8 |
| 16 | 2.0 | 0.8 |
| Deposition Rate | 3.1 | 3.0 |
| Emulsion pH | 4.0 | 4.1 |

As with the previous example, although the inclusion of the alkaline active surfactant had little effect on the emulsion characteristics, it did drastically increase the cleaning efficiency of the rolling oil. The alkaline cleaning tests were performed under the same conditions as the earlier example, with the exception that only the 180° F. temperature was used. This was done because most of the commercial cleaning of rolling oils is conducted at slightly above this temperature.

| Residual Carbons (μ grams/square inch) | Cleaned at 180° F. |
|---|---|
| Formula D | 50.5 |
| Formula E | 29.7 |

As with the previous example, the residual carbon level was significantly lower after alkaline cleaning when the alkaline active surfactant was included, indicating better cleaning performance.

A typical polyethoxyalkylamine has the structure

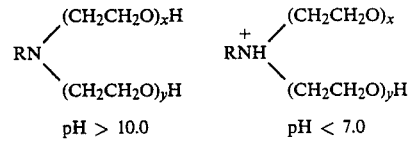

Preferably x+y is within the range of 8 to 20 and R is lower alkyl of less than five carbons.

A typical cationic surfactants is the ethoxylated cationic surfactant marketed under the trademark Ethomeen 18-20 (Armak Chemicals).

We claim:

1. In an acidic metal working lubricant composition for treatment of metal surfaces, whch composition has a pH of less than 7.0 and includes an unstable, oil-based water emulsion containing an emulsifying effective amount of an acidic active surface active agent to provide deposition of the oil onto the metal surfaces being treated; the improvement which comprises incorporated in the composition an oil emulsifying and cleansing effective amount of a polyethoxyalkylamine as an alakline activeated surface active agent to promote cleansing of the deposited oil from the metal surfaces during alkaline cleaning of the metal surfaces after metal working without affecting lubricant performance during metal working.

2. The composition of claim 1 wherein the oil is selected from the group consisting essentially of mineral oil, natural triglycerides, vegetable oils, wax, and synthetic oils.

3. The composition of claim 1 wherein the polyethoxyalkylamine has from 5 to 20 ethoxy units per mole.

4. The composition of claim 1 wherein the polyethoxyalkylamine comprises from 0.1% to 10.0% by weight of the nonaqueous ingredients of the composition.

5. The composition of any one of claims 1, 2, 3, or 4 wherein the oil comprises from about 80% to 99% by weight of the nonaqueous ingredients of the composition.

6. The composition of any one of claims 1, 2, 3, or 4 wherein the aqueous portion of the composition comprises from 80% to 99% by weight of the composition.

7. In the method for working metals in the presence of a lubricant composition, the improvement which comprises using the composition of claim 5 as the lubricant composition.

8. The method of claim 7 wherein the aqueous portion of the lubricant composition comprises from 80% to 99% by weight of the composition.

* * * * *